US005723241A

United States Patent [19]

Ueda

[11] Patent Number: 5,723,241

[45] Date of Patent: Mar. 3, 1998

[54] PHOTOSENSITIVE MEMBER COMPRISING THICK PHOTOSENSITIVE LAYER FORMED ON ANODIZED ALUMINUM LAYER

[75] Inventor: Hideaki Ueda, Kishiwada, Japan

[73] Assignee: Minolta Co., Ltd., Osaka, Japan

[21] Appl. No.: 743,135

[22] Filed: Nov. 4, 1996

Related U.S. Application Data

[63] Continuation of Ser. No. 427,735, Apr. 24, 1995, abandoned, which is a continuation of Ser. No. 171,449, Dec. 22, 1993, abandoned.

[30] Foreign Application Priority Data

Dec. 28, 1992 [JP] Japan ..... 4-348455
Oct. 29, 1993 [JP] Japan ..... 5-271667

[51] Int. Cl.[6] ..... G03G 5/047

[52] U.S. Cl. ..... 430/58; 430/65; 430/59

[58] Field of Search ..... 430/58, 65

[56] References Cited

U.S. PATENT DOCUMENTS

| | | | |
|---|---|---|---|
| 4,631,242 | 12/1986 | Emoto et al. | 430/58 |
| 4,702,983 | 10/1987 | Heino et al. | 430/58 |
| 4,800,144 | 1/1989 | Ueda et al. | 430/65 |
| 4,956,256 | 9/1990 | Ohtsuka et al. | 430/96 |
| 5,120,627 | 6/1992 | Nozomi et al. | 430/132 |
| 5,132,196 | 7/1992 | Hirayama et al. | 430/65 |
| 5,173,384 | 12/1992 | Otsuka | 430/59 |
| 5,225,878 | 7/1993 | Asano et al. | 355/219 |

FOREIGN PATENT DOCUMENTS 5-80567 4/1993 Japan .

*Primary Examiner*—Christopher D. Rodee
*Attorney, Agent, or Firm*—Burns, Doane, Swecker & Mathis, LLP

[57] ABSTRACT

The present invention provides a photosensitive member comprising an electrically conductive substrate having an anodized aluminum layer on the surface and a thick photosensitive layer on the substrate.

18 Claims, No Drawings

PHOTOSENSITIVE MEMBER COMPRISING THICK PHOTOSENSITIVE LAYER FORMED ON ANODIZED ALUMINUM LAYER

This application is a continuation of application Ser. No. 08/427,735, filed Apr. 24, 1995 abandoned, which is a continuation of application Ser. No. 08/171,449, filed Dec. 22, 1993 abandoned.

BACKGROUND OF THE INVENTION

1. Field of the Invention

The present invention relates to a photosensitive member for electrophotography composed of a thick photosensitive layer, which is excellent in wear resistance and electrical characteristics, and can form good copy images without image-defects and image-roughness.

2. Description of the Prior Art

Known photosensitive materials for forming a photosensitive layer include inorganic photoconductive materials such as selenium, cadmium sulfide or zinc oxide. These photosensitive materials have many advantages such as low loss of charges in the dark, an electrical charge which can be rapidly dissipated with irradiation of light and the like. However, they have disadvantages. For example, a photosensitive member based on selenium is difficult to produce, has high production costs and is difficult to handle due to inadequate resistivity to heat or mechanical impact. A photosensitive member based on cadmium sulfide has defects such as its unstable sensitivity in a highly humid environment and loss of stability with time because of the deterioration of dyestuffs, added as sensitizer, by corona charge and fading with exposure. These photosensitive members have also a problem from the viewpoint of safety.

Many kinds of organic photoconductive materials such as polyvinylcarbazole and the similar compounds have been proposed for forming an .organic photosensitive layer. These organic photoconductive materials have superior film forming properties, are light in weight, etc., but inferior in sensitivity, durability and environmental stability compared to the aforementioned inorganic photoconductive materials.

Various studies and developments have been in progress to overcome the above noted defects and problems. A function-divided organic photosensitive member of a laminated or a dispersed type has been proposed, in which a charge generating function and a charge transporting function are shared by different compounds. In usual, a photosensitive layer in the function-divided photosensitive member of the laminated type is composed of a charge generating layer containing an organic charge-generating material, a charge transporting layer containing an organic charge-transporting material and a binder resin. A photosensitive layer in the function-divided photosensitive member of the dispersion-type is composed of an organic charge-generating material and an organic charge-transporting material which are dispersed in a binder resin.

Such a function-divided organic photosensitive member can display performances excellent in electrophotographic properties such as chargeability, sensitivity, residual potential, durability with respect to copy and repetition, because most adequate materials can be selected from various materials. Moreover, function-divided photosensitive members have high productivity and low costs, since they can be prepared by coating, and suitably selected charge generating materials can freely control a region of photosensitive wavelength.

In particular, the function-divided photosensitive member of the dispersion-type can be used as a positively chargeable photosensitive member. The positively chargeable photosensitive member generates a little ozone and has an environmental resistance compared to a negatively chargeable photosensitive member. Therefore the function-divided photosensitive member of the dispersion-type has been paid to attention.

However, the organic photosensitive member is generally poor in mechanical strength and durability compared to the inorganic photosensitive member. A thickness of the organic photosensitive member decreases with its friction against toner, paper, a cleaning member and other similar loads in the copying machine. A layer-decreasing degree caused by wear depends on materials and mechanical systems, but generally it is 0.2–1 μm after 10,000 times of copy. The decrease of the layer-thickness causes the deterioration of chargeability. When the deterioration is beyond tolerance limits, the lifetime of the photosensitive member is over. As a result, the organic photosensitive member is poor in resistance to copy.

Therefore, it has been developed and researched that a photosensitive layer is made thick in order to improve durability and to make the lifetime of the photosensitive member long.

However when the thickness of a photosensitive layer is merely made thick, electrical charges accumulate in the photosensitive layer after the repetition use, resulting in remarkable increase of residual potential, deterioration of chargeability and image-disorders.

SUMMARY OF THE INVENTION

The object of the present invention is to provide a function-divided photosensitive member having a thick photosensitive layer of at least 27 μm, particularly 30–60 μm, which is thicker than a conventional photosensitive layer. The photosensitive member has high sensitivity, the electrical characteristics do not deteriorate and the increase of residual potential is low, even when it is used repeatedly.

The present invention relates to a photosensitive member comprising an electrically conductive substrate having an anodized aluminum layer on the surface and a thick photosensitive layer on the substrate.

DETAILED DESCRIPTION OF THE INVENTION

The present invention relates to a photosensitive member having a thick photosensitive layer compared to a conventional photosensitive layer, which can be prevented from accumulation of electrical charges in the photosensitive layer, deterioration of sensitivity and increase of residual potential, and can form copy images of high quality without image-defects.

The present invention has accomplished the above object by forming a photosensitive layer on an electrically conductive substrate having an anodized aluminum layer on the surface. The photosensitive layer includes function-divided photosensitive layers of both a dispersion-type and a laminated type in the present invention.

The anodized aluminum layer effects to prevent the accumulation of electrical charges in the photosensitive layer, the lowering of chargeability and the increase of residual potential even when the photosensitive layer is thick compared to a conventional photosensitive layer.

The anodized aluminum layer is explained hereinafter first.

The anodized aluminum layer is composed of a barrier layer and a porous layer on an electrically conductive substrate made of aluminum. The anodized aluminum layer is required to provide adhesivity, to prevent charge-injection and to have commutating properties.

It is required to make the barrier layer thick in order to provide a charge-injection preventive properties for the barrier layer. However, if the barrier layer is too thick, a residual potential increases to cause lowering of sensitivity and fogs after repetition uses. Accordingly a desirable thickness of the barrier layer is within the range between 10 and 1,000 Å, preferably 10 and 500 Å.

The porous layer effects to provide adhesivity. The porous layer is required to have a certain thickness. However, if the layer is too thick, a residual potential or an electrical current in the dark may increase. Accordingly a desirable thickness of the porous layer is within the range between 0.5 and 15 μm, preferably 1 and 10 μm, more preferably 2 and 8 μm.

More preferably, the anodized aluminum layer is partially subjected to a pore-sealing treatment. The wording "partially" means that cavities of pores in the layer are remained and the surfaces of the cavities are sealed. A degree of sealing may be adjusted by a pore-sealing treatment time, a density of a sealing agent and a temperature of a solution. In the partial pore-sealing treatment, impurities, such as nickel, are incorporated in the anodized aluminum layer. Such a impurity makes electrons flow smoothly. The barrier layer prevents injection of positive holes. As a result, excellent commutating properties can be achieved.

The anodized aluminum layer is formed as follows. As the substrate for the photosensitive member, an aluminum substrate having an optional shape, such as a cylindrical shape, is used. The aluminum substrate is set as an anode and subjected to electrolysis in an electrolyte containing sulfuric acid or oxalic acid etc. An anodized aluminum layer is formed on the surface of the substrate. The thickness of the barrier layer may be controlled by an electrolytic voltage. The thickness of the porous layer may be controlled by an electrolytic time.

The pore-sealing treatment is carried out in a nickel acetate solution or a nickel fluoride solution. A density of a sealing agent is between 1–15 wt %, preferably 5–10 wt %. A preferable temperature of the solution is set at 30°–80° C.

An amount of impurities in the anodized aluminum layer may be adjusted by a material of aluminum alloy and anodizing conditions.

The anodized aluminum layer may contain metals, such as manganese, chromium, zinc and titanium as well as magnesium, iron, copper, silicone in so far as these metals do not cause charge-injection. A content, however, should be at most 0.1 wt %. The quantities of such metals can be determined by Auger electron spectroscopy or emission spectrochemical analysis.

An impedance of the anodized aluminum is adjusted within the range between 1–300 KΩ, preferably 50–250 KΩ, more preferably 100–250 KΩ. Thereby electrophotographic properties which are supposed to deteriorate by the aluminum-anodizing treatment, such as increase of residual potential and repetition properties, can be improved.

The impedance may be controlled by an electrolytic voltage and an electrolytic time. The impedance may be also controlled by the pore-sealing treatment. If the impedance of the anodized aluminum layer is too low, the anodized aluminum layer does not work as an injection-preventive layer. Further charge-keeping ability is low and a number of white spots are formed in copy images at the time of repetition use. If the impedance of the anodized aluminum layer is too high, a residual potential becomes high at an initial stage, so that the sensitivity is deteriorated, a residual potential increases with repetition copy and fogs are formed in copy images.

The impedance may be measured according to the standard method of ASTM-B457-67, in which A–C impedance bridge is applied, a 35% salt solution is used as an electrolyte and the measurement is carried out repeatedly under 1,000 Hz conditions at different portions to give an impedance as an average value.

The impedance of the anodized aluminum layer is in proportion to a layer thickness and in inverse proportion to a measuring area, and further influenced by a measuring temperature. The impedance of the anodized aluminum layer is converted to an impedance in the case where it is measured under the conditions of the measuring area of 0.129 $cm^2$ and the measuring temperature of 25° C.

Charge-injection preventive properties are also much influenced by impurities in the anodized aluminum layer. If iron, copper or silicone are contained much as impurities, the charge-injection preventive properties and the commutating properties are much influenced. In particular, it is desirable that the impurities, such as silicone, copper and iron, which are supposed to cause the charge-injection, are contained as lowly as possible in the present invention. If magnesium and silicone are contained, a magnesium-silicon alloy, which brings about bad influences, may be formed. Therefore it is preferable that the above metals are contained at an amount as low as possible.

As to the electrically conductive substrate used for the photosensitive member of the present invention, a cylindrical substrate is generally used. For example, a cut pipe in which an aluminum pipe which is processed by a pultrusion process after an extrusion process is cut and an about 0.2–0.3 mm thickness portion of the outer surface of the pipe is cut off by means of a cutting apparatus, such as a diamond bit; a DI pipe in which an aluminum disk is deep-drawn to have a cup-like shape and then the outer surface is finished by ironing; an EI pipe in which an aluminum disk is impact-processed to have a cup-like shape and then the outer surface is finished by ironing; and an ED pipe in which aluminum is cold-drawn after an extrusion process; may be used. The surfaces of these pipes above mentioned may be further cut. Besides the above mentioned substrates, a foil or sheet-like plate of aluminum may be used as a substrate. The foil or the plate may be laminated on a plastic film.

After the anodized aluminum is formed on the surface of an electrically conductive substrate, a photosensitive layer is formed on the anodized layer to give a photosensitive member of the present invention.

The function-divided photosensitive layer of the dispersion type in which a charge generating material and a charge transporting material are dispersed in a binder resin is explained first.

Such a photosensitive layer may be prepared as follows. The charge generating material and the charge transporting material are dispersed in a solution containing a binder resin dissolved in a solvent. The dispersion solution is applied to the anodized aluminum layer, followed by drying. The photosensitive layer is formed so that a thickness of the layer may be within the range between 30–60 μm, preferably 35–60 μm. Further, a photosensitive member of the present invention may have a surface protective layer, an undercoat layer or an intermediate layer if necessary.

The coating of the photosensitive layer may be carried out by an applicator, a spray coater, a bar coater, a dip-coater, a roll-coater, a doctor coater and other known coating machines.

A desirable content of the charge generating material in the photosensitive layer is within the range between 0.01 and 2 parts by weight, preferably 0.2 and 1.5 parts by weight on the basis of 1 part by weight of the binder resin. If the content is too low, sensitivity can not be achieved satisfactorily. If the content is too high, coatability becomes poor, resulting in poor mechanical strength of the photosensitive layer. A desirable content of the charge transporting material in the photosensitive layer is within the range between 0.01 and 2 parts by weight, preferably 0.03 and 1.3 parts by weight on the basis of 1 part by weight of the binder resin. If the content is too low, sensitivity can not be achieved satisfactorily. If the content is too high, chargeability becomes poor and a mechanical strength of the photosensitive layer becomes poor.

When the binder resin is selected in combination with the charge transporting material so that a mobility of electrical charges in the photosensitive layer may be $5\times10^{-6}cm^2/V.sec$ or more under $2\times10^5$ V/cm, durability and sensitivity can be improved much more.

A charge generating material useful for the present photosensitive member is exemplified by organic substances, such as bisazo dyes, triarylmethane dyes, thiazine dyes, oxazine dyes, xanthene dyes, cyanine coloring agents, styryl coloring agents, pyrylium dyes, azo dyes, quinacridone pigments, indigo pigments, perylene pigments, polycyclic quinone pigments, bisbenzimidazole pigments, indanthrone pigments, squalylium pigments and phthalocyanine pigments. Any other material is also usable insofar as it generates charge carriers very efficiently upon adsorption of light.

A charge transporting material useful for the present invention is exemplified by hydrazone compounds, pyrazoline compouns, styryl compounds, triphenyl methane compounds, oxadiazole compounds, carbazole compounds, stilbene compounds, enamine compounds, oxazole compounds, triphenylamine compounds, tetraphenyl benzidine compounds and azine compounds. In more particularly, p-diphenylaminobenzaldehyde-N,N-diphenyl hydrazone, 2-methyl-4-N,N-diphenylamino-β-phenylstilbene, α-phenyl-4-N,N-diphenylaminostilbene, α-phenyl-4-N-phenyl, N-p-tolylvinylphenylaminostilbene and 1,1,4,4-bisdiethylaminotetraphenylbutadiene may be used singly or in combination with other compounds.

A desirable binder resin useful for the preparation of the above photosensitive member is electrically insulating and has an electrical resistance of $1\times10^{12}$ Ωcm or higher when measured singly. Conventional binder resins, such as thermoplastic resins, thermosetting resins, photocuring resins and photoconductive resins may be used.

Concrete examples of the binder resins are thermoplastic resins such as saturated polyesters, polyamides, acrylic resins, ethylene-vinyl acetate copolymers, ion cross-linked olefin copolymers (ionomers), styrene-butadiene block copolymers, polycarbonates, vinyl chloride-vinyl acetate copolymers, cellulose esters, polyimides, styrol resins and other similar resins; thermosetting resins such as epoxy resins, urethane resins, silicone resins, phenolic resins, melamine resins, xylene resins, alkyd resins, thermosetting acrylic resins and other similar resins; photocuring resins; photoconductive resins such as poly(vinyl carbazoles), poly (vinyl anthracenes), poly(vinyl pyrroles) and other similar resins. Any of these resins may be used singly or in combination with other resins. When the charge transporting material itself can be used as a binder resin, other binder resin may not be used.

A photosensitive member of the present invention permits, in combination with the binder, the use of a plasticizer such as halogenated paraffin, polybiphenyl chloride, dimethyl naphthalene, dibuthyl phthalate and o-terphenyl, the use of an electron-attracting sensitizer such as chloranyl, tetracyanoethylene, 2,4,7-trinitro-fluorenone, 5,6-dicyanobenzoquinone, tetracyanoquinodimethane, tetrachlorophthalic anhydride and 3,5-dinitrobenzoic acid, or the use of a sensitizer such as methyl violet, rhodamine B, cyanine dyes, pyrylium salts and thiapyrylium salts.

A solvent which can dissolve the above resins should be selected depending on the binder resins, but may be exemplified by an aromatic solvent such as benzene, toluene, xylene and chlorobenzene, a ketone such as acetone, methyl ethyl ketone and cyclohexanone, an alcohol such as methanol, ethanol and isopropanol, an ester such as ethyl acetate and ethyl Cellosolve, a halogenated hydrocarbon such as carbon tetrachloride, carbon tetrabromide, chloroform, dichloromethane and tetrachloroethane, an ether such as tetrahydrofuran and dioxane, an amide such as dimethyl formamide, dimethyl sulfoxide and diethyl formamide. These solvents may be used singly or in combination with other solvents.

Then the function-divided photosensitive layer of the laminated type is explained hereinafter.

A charge generating layer is formed on the anodized aluminum layer. The charge generating layer may be a layer containing fine particles of a charge generating material dispersed in a binder resin or may be a deposited layer formed by a vacuum metallizing method. The present invention is particularly useful for the dispersion type. The binder resin useful for the dispersion type is exemplified by poly (vinyl acetates), polyacrylates, polymethacrylates, polyesters, polycarbonates, poly(vinyl butyrals), phenoxy resins, cellulose and urethane resins. The charge generating layer is formed to have a layer thickness of at most 4 μm, preferably at most 2 μm.

The charge generating material may be exemplified by inorganic materials, for example, selenium, selenium alloys such as selenium-tellurium and selenium-arsenic, cadmium selenide, zinc oxide and amorphous silicone as well as the organic materials which may be used for the function-divided photosensitive layer of the dispersion type as above mentioned. Any other material is also usable insofar as it generates charge carriers very efficiently upon adsorption of light. In particular, azo pigments are preferable.

The charge generating material is contained at an amount of 0.1–10 parts by weight, preferably 0.2 5 parts by weight on the basis of 1 part by weight of the binder resin.

A charge transporting layer is formed on the charge generating layer. The charge transporting layer contains a charge transporting material dispersed in a binder resin.

The binder resin is selected in combination with the charge transporting material so that a mobility of electrical charges in the charge transporting layer may be $5\times10^{-6}cm^2/V.sec$ or more under $2\times10^5$ V/cm. The synergistic effect achieved by the combination of such a charge transporting layer with the electrically conductive substrate having the anodized aluminum layer on the surface thereon makes it possible to form a thick charge transporting layer of 27 μm or more, particularly 30–60 μm, which is thicker than a conventional charge transporting layer having a thickness between 10 and 20 μm. Although the charge transporting layer is made thick, electrical characteristics do not deteriorate. In more detail, the increase of residual potential is small from the viewpoint of practical use. The sensitivity is rather improved. A photosensitive member of the present invention has high sensitivity and excellent durability, and can form copy images of high quality without image-defects, compared to the conventional ones.

The charge transporting material which may be selected from the above viewpoints is exemplified by an electron attracting compound such as 2,4,7-trinitrofluorenones and tetracyanoquinodimethanes, a heterocyclic compound such as carbazoles, indoles, imidazoles, oxazoles, thiazoles, oxathiazoles, pyrazoles, pyrazolines, thiadiazoles, triphenylamine compounds, styryl compounds, aniline derivatives, hydrazone derivatives, a conjugated compound having a stilbene structure, and an electron donating compound such as polymers incorporating the above compounds as a substituent bonded to a main chain or a side chain.

The binder resin in which the charge transporting material is dispersed is exemplified by a thermoplastic resin such as polycarbonate resins, acrylic resins, methacrylic resins, polyester resins, polystyrene resins and silicone resins, and many thermosetting resins. In particular, polycarbonate resins and polyester resins are preferable because they wear away but being hardly injured. Bisphenol A, bisphenol C, bisphenol Z and other similar compounds may be used as a bisphenol component in the polycabonates. Polycarbonates composed of bisphenol C or bisphenol Z preferable.

The charge transporting material is contained in the charge transporting layer at an amount of 0.02–2 parts by weight, preferably 0.2–1.3 parts by weight on the basis of 1 part by weight of the binder resin.

Further the charge transporting layer may contain other conventional additives in order to improve coatability and flexibility or to restrain the accumulation of residual potential.

The charge transporting layer of the present invention permits, in combination with the binder, the use of a plasticizer such as halogenated paraffin, polybiphenyl chloride, dimethyl naphthalene, dibuthyl phthalate and o-terphenyl, the use of an electron-attracting sensitizer such as chloranyl, tetracyanoethylene, 2,4,7-trinitro-fluorenone, 5,6-dicyanobenzoquinone, tetracyanoquinodimethane, tetrachlorophthalic anhydride, 3,5-dinitrobenzoic acid, cyano vinyl compounds and malodinitrile compounds, or the use of a sensitizer such as methyl violet, rhodamine B, cyanine dyes, pyrylium salts and thiapyrylium salts.

A photosensitive member of the present invention may have an intermediate layer between the anodized aluminum layer and the photosensitive layer. Thereby, the improvement of adhesivity and coatability, the protection of the substrate and the restraint of charge injection into the photosensitive layer from the substrate can be achieved. A material useful for forming the intermediate layer is exemplified by polyimides, polyamides, nitrocelluloses, poly (vinyl butyrals), poly(vinyl alcohol) and other similar compounds. A desirable thickness of the layer is 1 μm or less. A material having a low electrical resistance may be dispersed in the intermediate layer.

A photosensitive member of the present invention may have a surface protective layer. A material useful for forming the surface protective layer is exemplified by acrylic resins, polyaryl resins, polycarbonate resins, urethane resins, thermosetting resins, photocuring resins. These polymers may be used singly. A material of low electrical resistance, such as tin oxide, indium oxide and other similar compounds may be dispersed in the surface protective layer. A desirable thickness of the surface protective layer is 5 μm or less.

A plasma-polymerized organic layer may be applied to the surface protective layer. The plasma-polymerized organic layer may contain an oxygen atom, a nitrogen atom, a halogen atom, and an atom in group III or V of the periodic table, if necessary.

A photosensitive member of the present invention may be applied, for example, not only to a copying machine but also to a printer or a facsimile which is equipped with a light source, such as a laser, a light emitting diode (LED), a LCD shutter and a Braun tube.

The present invention is further explained with reference to a number of specified examples. It is, of course, not the intention hereby to limit the scope of the invention. In the examples, "part(s)" means "part(s) by weight" in so far as it is not explained particularly.

EXAMPLE 1—1

An aluminum pipe made of JIS6063 alloy the surface of which had been planished was etched in a 1% aqueous solution of sodium hydroxide at 30° C. for 5 minutes. Then the aluminum pipe was washed with water and dipped for 1 minute in a 7% sulfric acid solution at 25° C. After washed with water, the aluminum pipe was anodized at a current density of 1.0 A/dm$^2$ in an electrolyte containing sulfuric acid at 150 g/l to give an anodized aluminum layer having a mean layer thickness of 6 μm (barrier layer=300 Å). Further after washed with water, the aluminum pipe was dipped in an aqueous solution containing nickel acetate at 10 g/l at 80° C. for 30 minutes. The aluminum pipe was pulled up and washed with water. The impedance of the pipe was 85 KΩ.

An azo compound represented by the following chemical formula:

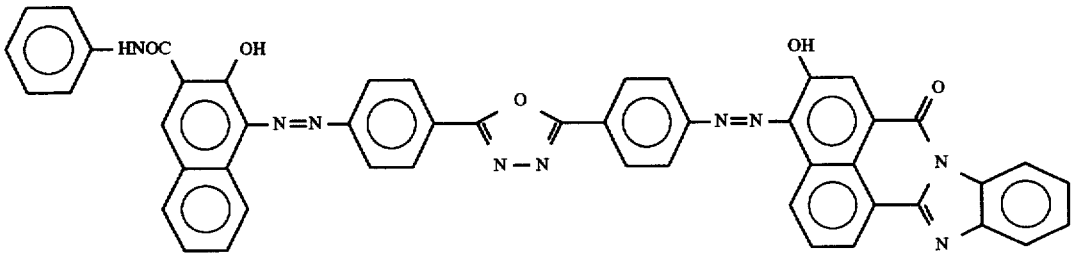

of 1.5 parts, a distyryl compound represented by the following chemical formula:

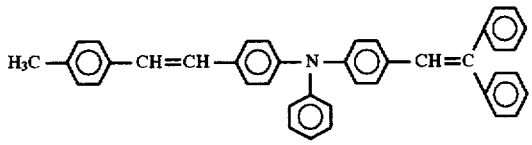

of 40 parts and polycarbonate resin (Panlite K-1,300; made by Teijin Kasei K. K.) of 60 parts were dispersed in 1,4-dioxane of 500 parts for 24 hours in a sand mill.

The obtained dispersion solution was applied onto the anodized aluminum layer so that a thickness of the photosensitive layer would be 35 μm after drying. Thus a function-divided photosensitive member of a dispersion type was obtained.

EXAMPLE 1-2

An aluminum pipe made of JIS3003 alloy the surface of which had been subjected to a cutting treatment was etched in a 1% aqueous solution of sodium hydroxide at 30° C. for 5 minutes. Then the aluminum pipe was washed with water and dipped in a 1% nitric acid solution at 25° C. for 1 minute. After washed with water, the aluminum pipe was anodized at 20±1° C. under a bath-voltage of 30 V and a current density of 1.2 A/dm$^2$ in an electrolytic bath containing a 7 vol % sulfric acid solution to give an anodized aluminum layer having a mean layer thickness of 4 μm (barrier layer=420 Å).

After washed with water, the aluminum pipe was dipped in an aqueous solution containing nickel fluoride at 7 g/l at 70° C. for 10 minutes. The aluminum pipe was pulled up and washed with water. The impedance of the pipe was 120 KΩ.

Metal-free phthalocyanine of τ-type of 1 part, polycarbonate resin (PC-Z; made by Mitsubishi Gas Kagaku K. K.) of 20 parts, a butadiene compound represented by the following chemical formula:

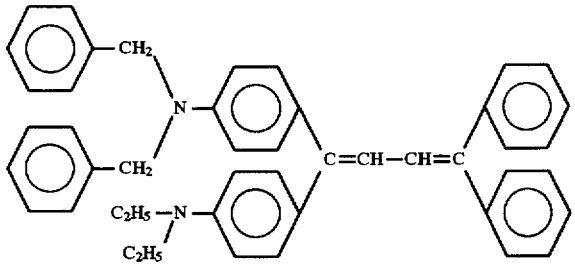

of 20 parts, a hindered phenol compound (Irganox 565 ;made by Ciba-Geigy K. K.) of 2 parts, fluorosilicone oil (X-22-8-19; made by Shinetsu Kagaku K. K.) of 0.01 part and tetrahydrofuran (THF) of 180 parts were mixed for dispersion for 12 hours in a sand mill.

The obtained dispersion solution was applied onto the anodized aluminum layer so that a thickness of the photosensitive layer would be 40 μm after drying. Thus a function-divided photosensitive member of a dispersion type was obtained.

EXAMPLE 1-3

The outer surface of a cylindrical substrate made of aluminum was planished by a cutting treatment. After washed with dichloromethane, the aluminum pipe was anodized at a current density of 2.5 A/dm$^2$ at 20° C. for 10 minutes in an electrolyte containing sulfuric acid at 100 g/l to give an anodized aluminum layer having a mean layer thickness of 7 μm (barrier layer=800 Å). Further after washed with water, the aluminum pipe was dipped in an aqueous solution containing nickel acetate at 8 g/l at 90° C. for 10 minutes. The aluminum pipe was pulled up and washed with water. The impedance of the pipe was 190 KΩ.

A titanyl phthalocyanine pigment of 5 parts, a diamino compound represented by the following chemical formula:

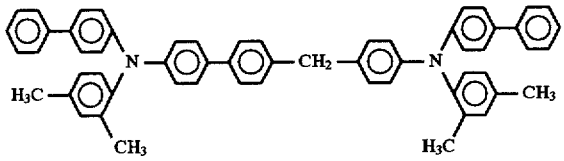

of 50 parts and a polyarylate resin (U-polymer U-100; made by Yunithika K. K.) of 50 parts were dispersed for 24 hours in a mixed solvent of dichloroethane of 400 parts and dibutyl-hydroxy-toluene of 10 parts in a sand mill.

The obtained dispersion solution was applied onto the anodized aluminum layer so that a thickness of the photosensitive layer would be 45 μm after drying. Thus a function-divided photosensitive member of a dispersion type was obtained.

COMPARATIVE EXAMPLE 1—1

A photosensitive member was prepared in a manner similar to Example 1—1 except that the substrate was not anodized in Example 1—1.

COMPARATIVE EXAMPLE 1-2

A photosensitive member was prepared in a manner similar to Example 1—1 except that a thickness of the photosensitive layer was 20 μm.

EVALUATION

The obtained photosensitive members were installed in a copying machine (EP-5,400; made by Minolta Camera K. K.) respectively. The photosensitive member was corona-charged at a +5KV power to measure an initial surface potential ($V_0$ (V)), an exposure amount for half reducing ($E_{1/2}$(lux.sec)), a dark decreasing ratio ($DDR_1$(%)) and a residual potential (Vr(V)). The exposure amount for half reducing is the exposure amount required for the surface potential to be half the value of the initial surface potential. The dark decreasing ratio is the ratio of a reduced charge amount to the initial charge amount after the initially charged photosensitive member is left in the dark for 1 seconds. The residual potential is measured after the irradiation of erasing light (50 lux.sec). Further the obtained photosensitive members were respectively subjected to a durability test with respect to 150,000 times of a continuous copy. After the durability test, the initial surface potential ($V'_0$ (V)), the exposure amount for half reducing ($E'_{1/2}$ (lux.sec)), the dark decreasing ratio ($DDR'_1$(%)) and the residual potential (Vr'(V)) were measured. The results were summarized in Table 1.

TABLE 1

| | initial | | | | after 150000 times of copy | | | |
|---|---|---|---|---|---|---|---|---|
| | $V_0$ (V) | $E_{1/2}$ (lux. sec) | $DDR_1$ (%) | Vr (V) | $V'_0$ (V) | $E'_{1/2}$ (lux. sec) | $DDR'_1$ (%) | Vr' (V) |
| Ex1-1 | +650 | 0.8 | 11.0 | 15 | +620 | 1.6 | 15.2 | 35 |
| Ex1-2 | +645 | 0.9 | 10.3 | 20 | +635 | 1.2 | 13.0 | 60 |
| Ex1-3 | +650 | 0.7 | 9.7 | 10 | +630 | 1.0 | 13.7 | 50 |
| CE1-1 | +640 | 0.8 | 12.5 | 17 | +580 | 2.4 | 23.1 | 50 |
| CE1-2 | +630 | 1.2 | 13.0 | 15 | +500 | 3.4 | 24.5 | 80 |

Ex: Example
CE: Comparative Example

With respect to copy images, white spots in black-solid images, image-defects, white spots in half-tone images and an image density (ID) of black-solid images were evaluated to be ranked as follows:

White Spots in Black-Solid Images o; almost no white spots were observed visually in black-solid images, Δ; a few white spots were observed but there was no problem in practical use, x; a number of white spots were observed and there was a problem in practical use, -; evaluation was not made.

White Spots in Half-Tone Images o; images in gray were reproduced well when observed visually, Δ; a few white spots were observed in copy images in gray but there was no problem in practical use, x; a number of white spots were observed and there was a problem in practical use, -; evaluation was not made.

Image-Defects o; fine lines were reproduced well when observed visually,

Δ; a few defects in copy images of fine lines were observed but there was no problem in practical use, x; defects in copy images of fine lines were remarkable and there was a problem in practical use, -; evaluation was not made.

Image Density (ID) of Black-Solid Images o; I.D. is more than 1.5,

Δ; I.D. is within the range between 1.0 and 1.5, x; I.D. is less than 1.0,

-; evaluation was not made.

The results are summarized in Table 2.

TABLE 2

| | image evaluation | | | |
|---|---|---|---|---|
| | white spot | half | image-defect | black solid (I.D) |
| Ex1-1 | o | o | o | o |
| Ex1-2 | o | o | o | o |
| Ex1-3 | o | o | o | o |
| CE1-1 | Δ | x | x | Δ |
| CE1-2 | x | x | x | x |

Ex; Example
CE; Comparative Example

EXAMPLE 2-1

An aluminum pipe made of JIS6063 alloy the surface of which had been planished was etched in a 1% aqueous solution of sodium hydroxide at 30° C. for 5 minutes. Then the aluminum pipe was washed with water and dipped for 1 minute in a 7% sulfric acid solution at 25° C. After washed with water, the aluminum pipe was anodized at a current density of 1.0 A/dm$^2$ in an electrolyte containing sulfuric acid at 150 g/l to give an anodized aluminum layer having a mean layer thickness of 6 μm (barrier layer=300 Å). Further after washed with water, the aluminum pipe was dipped in an aqueous solution containing nickel acetate at 10 g/l at 80° C. for 30 minutes. The aluminum pipe was pulled up and washed with water. The impedance of the pipe was 85 KΩ.

An azo compound represented by the following chemical formula:

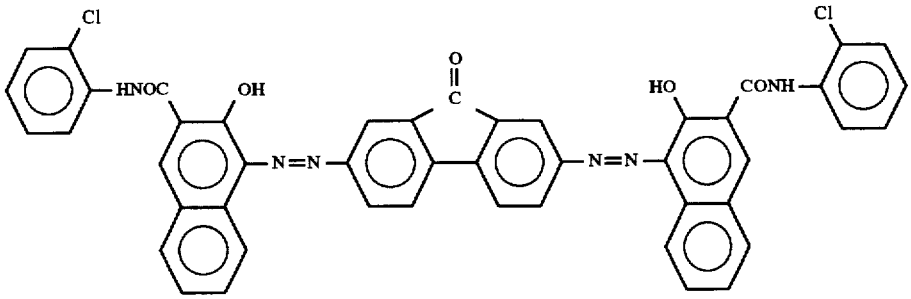

of 1 part, a polyester resin (Vylon 200; made by Toyo Boseki K. K.) of 1 part were dispersed in cyclohexanone of 500 parts in a sand mill. The obtained dispersion solution was diluted with tetrahydrofuran of 500 parts and applied onto the anodized aluminum layer. Thus a charge generating layer was formed so that a thickness of the charge generating layer would be about 0.3 μm after drying.

Then a diamino compound represented by the following chemical formula:

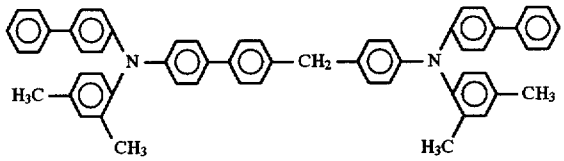

of 50 parts, bisphenol Z polycarbonate of 50 parts, a cyano compound represented by the following formula:

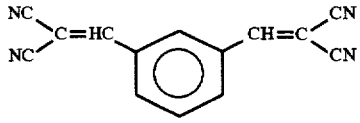

of 1.5 parts and ter-butyl-hydroxy-toluene of 4 parts were dissolved in dichloromethane. The obtained solution was applied onto the charge generating layer by a dipping method. Thus a charge transporting layer was formed so that a thickness of the charge transporting layer would be 10 μm, 20 μm, 30 μm or 40 μm. Thus obtained photosensitive members are referred to as Photosensitive member A, B, C and D respectively.

A mobility of electrical charges in the charge transporting layer was $4\times10^{-5}$ $cm^2/V.sec$ under $2\times10^5$ V/cm.

EXAMPLE 2—2

An aluminum pipe made of JIS3003 alloy the surface of which had been subjected to a cutting treatment was etched in a 1% aqueous solution of sodium hydroxide at 30° C. for 5 minutes. Then the aluminum pipe was washed with water and dipped in a 5% nitric acid solution at 25° C. for 1 minute. After washed with water, the aluminum pipe was anodized at 20°±1° C. under a bath-voltage of 30 V and a current density of 1.2 $A/dm^2$ in an electrolytic bath containing a 7 vol % sulfric acid solution to give an anodized aluminum layer having a mean layer thickness of 4 μm (barrier layer=420 Å).

After washed with water, the aluminum pipe was dipped in an aqueous solution containing nickel fluoride at 7 g/l at 70° C. for 10 minutes. The aluminum pipe was pulled up and washed with water. The impedance of the pipe was 120 KΩ.

A bisazo pigment represented by the following chemical formula:

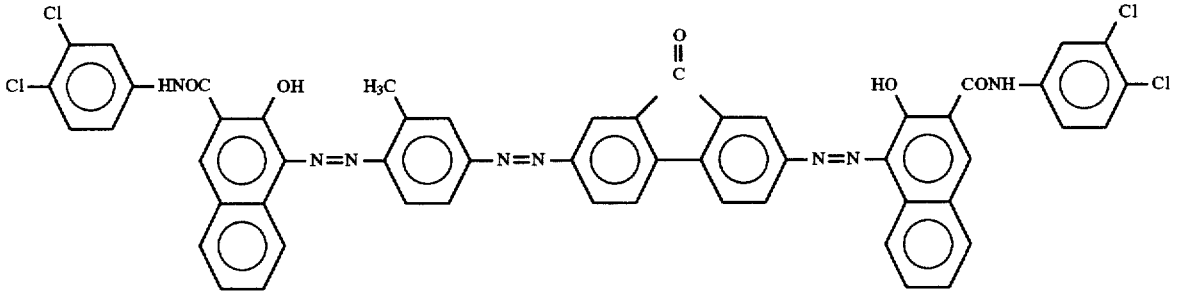

of 1 part, polyvinylbutyral (BX-1; made by Sekisui Kagaku K. K.) of 1 part were dispersed in cyclohexanone of 500 parts in a sand mill. The obtained dispersion solution was diluted with methyl ethyl ketone of 500 parts and applied onto the anodized aluminum layer. Thus a charge generating layer was formed so that a thickness of the charge generating layer would be about 0.2 μm after drying.

Then a hydrazone compound represented by the following chemical formula:

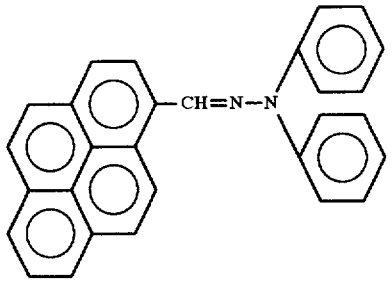

of 50 parts, bisphenol C polycarbonate of 50 parts, a cyano compound represented by the following formula:

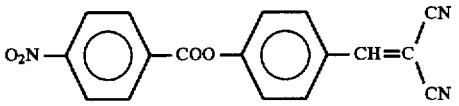

of 0.5 parts and di-ter-butyl-hydroxy-toluene of 4 parts were dissolved in tetrahydrofuran. The obtained solution was applied onto the charge generating layer. Thus a charge transporting layer was formed so that a thickness of the charge transporting layer would be 35 μm. The obtained photosensitive member is referred to as Photosensitive member E.

A mobility of electrical charges in the charge transporting layer was $5.3\times10^{-6}$ $cm^2/V.sec$ under $2\times10^5$ V/cm.

EXAMPLE 2-3

An aluminum drum made of JIS6063 alloy was treated in a manner similar to Example 2-1 to form an anodized aluminum layer having a mean thickness of 2 μm (barrier layer=50 Å).

A bisazo pigment represented by the following chemical formula:

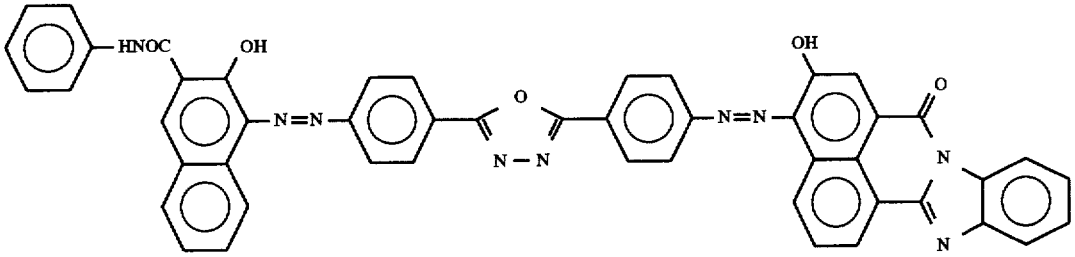

of 1 part, a phenoxy resin (PKHH; made by Union Carbide K. K.) of 0.5 parts and a polyvinylbutyral resin (#6,000; made by Denka Kogyo K. K.) of 0.5 parts were dispersed in cyclohexanone of 500 parts in a sand mill. The obtained dispersion solution was diluted with 1,4-dioxane of 500 parts and applied onto the anodized aluminum layer. Thus a charge generating layer was formed so that a thickness of the charge generating layer would be about 0.3 μm after drying.

Then a distyryl compound represented by the following chemical formula:

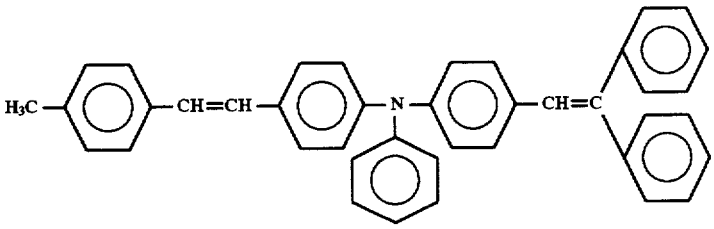

of 50 parts, bisphenol A polycarbonate of 60 parts, a cyano compound represented by the following formula:

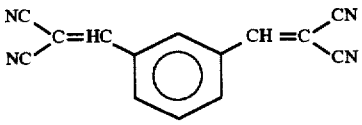

of 1.5 parts and di-ter-butyl-hydroxy-toluene of 4 parts were dissolved in 1,4-dioxane. The obtained solution was applied onto the charge generating layer in a dipping method. Thus a charge transporting layer was formed so that a thickness of the charge transporting layer would be 28 μm or 33 μm. Thus obtained photosensitive members are referred to as Photosensitive members F and G respectively.

A mobility of electrical charges in the charge transporting layer was $4.2\times10^{-5}$ $cm^2/V.sec$ under $2\times10^5$ V/cm.

COMPARATIVE EXAMPLE 2-1

A photosensitive member was prepared in a manner similar to the Photosensitive member C having the 30 μm charge transporting layer in Example 2-1, except that an aluminum substrate was not anodized. Thus obtained photosensitive member is referred to as Photosensitive member H.

COMPARATIVE EXAMPLE 2—2

Photosensitive member I was prepared in a manner similar to Comparative Example 2-1, except that N-methylcarbazole-3-aldehyde-N,N,-diphenylhydrazone of 50 parts was used as a charge transporting material.

The photosensitive members obtained in Examples 2-1 to 2-3 and Comparative Examples 2-1 and 2—2 were evaluated similarly as above mentioned, except that each photosensitive member was corona-charged at a −5KV power and that $DDR_5$ was measured after the initially charged photosensitive member was left in the dark for 5 seconds. The results are summarized in Tables 3 and 4.

TABLE 3

| | initial | | | | after 150000 times of copy | | | |
|---|---|---|---|---|---|---|---|---|
| PSM | $V_0$ (V) | $E_{1/2}$ (lux. sec) | $DDR_5$ (%) | Vr (V) | $V'_0$ (V) | $E'_{1/2}$ (lux. sec) | $DDR'_5$ (%) | Vr' (V) |
| A | −610 | 1.2 | 3.1 | 0 | ** | — | — | — |
| B | −650 | 0.8 | 2.2 | −2 | −560 | 2.1 | 13.5 | −20 |
| C | −660 | 0.6 | 2.0 | −5 | −600 | 1.0 | 10.2 | −30 |
| D | −680 | 0.5 | 1.8 | −5 | −650 | 0.8 | 7.0 | −40 |
| E | −680 | 0.6 | 2.4 | −10 | −640 | 1.1 | 10.5 | −50 |
| F | −670 | 0.6 | 2.3 | −3 | −620 | 0.9 | 12.3 | −30 |
| G | −680 | 0.5 | 2.1 | −5 | −640 | 0.8 | 9.6 | −35 |
| H | −660 | 0.6 | 2.3 | −5 | −550 | 1.1 | 14.0 | −40 |
| I | −660 | 0.7 | 2.5 | −15 | −560 | 2.5 | 15.8 | −80 |

PSM; photosensitive member

**; the photosensitive member could not be charged after 50,000 times of copy.

TABLE 4

| | image evaluation | | | |
|---|---|---|---|---|
| PSM | white spot | half | image-defect | black solid (I.D) |
| A | — | — | — | — |
| B | Δ | x | x | x |
| C | o | o | o | o |
| D | o | o | o | o |
| E | o | o | o | o |
| F | o | o | o | o |
| G | o | o | o | o |

TABLE 4-continued

| | image evaluation | | | |
|---|---|---|---|---|
| PSM | white spot | half | image-defect | black solid (I.D) |
| H | x | x | x | o |
| I | x | x | x | o |

PSM; photosensitive member

What is claimed is:

1. A laminated photosensitive member comprising a charge transporting layer having a thickness of at a least 35 μm and having a mobility of electrical charges of at least $5\times10^{-6}cm^2/V.sec$ under an electrical field of $2\times10^5$ V/cm;

a charge generating layer; and an electrically conductive substrate having an anodized aluminum layer on the surface, the anodized aluminum layer comprising a porous layer having a thickness of 0.5 to 15 μm and a barrier layer having a thickness of 10 to 500 Å and having an impedance of 50 to 250 KΩ wherein the charge transporting layer and the charge generating layer are laminated on the surface of the substrate.

2. The laminated photosensitive member of claim 1, in which the anodized aluminum layer is subjected to a pore-sealing treatment.

3. The laminated photosensitive member of claim 1, in which a thickness of the charge generating layer is 4 μm or less.

4. The laminated photosensitive member of claim 1, in which the charge generating layer comprises a binder resin and a charge generating material.

5. The laminated photosensitive member of claim 4, in which the charge generating material is contained in the charge generating layer at an amount of 0.1 to 10 parts by weight on the basis of 1 part by weight of the binder resin.

6. The laminated photosensitive member of claim 1, in which the charge transporting layer comprises a binder resin and a charge transporting material.

7. The laminated photosensitive member of claim 6, in which the charge transporting material is contained in the charge transporting layer at an amount of 0.02 to 2 parts by weight on the basis of 1 part by weight of the binder resin.

8. The laminated photosensitive member of claim 1, in which an impedance of the anodized aluminum layer is within the range between 100 and 250 KΩ.

9. The laminated photosensitive member of claim 1, wherein the charge transporting layer has a thickness of 35 μm to 60 μm.

10. A laminated photosensitive member comprising a charge transporting layer having a thickness of at least 33 μm and having a mobility of electrical charges of at least $5\times10^{-6}cm^2/V.sec$ under an electrical field of $2\times10^5$ V/cm;

a charge generating layer; and an electrically conductive substrate having an anodized aluminum layer on the surface, the anodized aluminum layer comprising a porous layer having a thickness of 0.5 to 15 μm and a barrier layer having a thickness of 10 to 500 Å and having an impedance of 50 to 250 KΩ wherein the charge transporting layer and the charge generating layer are laminated on the surface of the substrate.

11. A laminated photosensitive member of claim 10, in which the anodized aluminum layer is subjected to a pore-sealing treatment.

12. A laminated photosensitive member of claim 10, in which a thickness of the charge generating layer is 4 μm or less.

13. The laminated photosensitive member of claim 10, in which the charge generating layer comprises a binder resin and a charge generating material.

14. The laminated photosensitive member of claim 13, in which the charge generating material is contained in the charge generating layer at an amount of 0.1 to 10 parts by weight on the basis of 1 part by weight of the binder resin.

15. The laminated photosensitive member of claim 10, in which the charge transporting layer comprises a binder resin and a charge transporting material.

16. The laminated photosensitive member of claim 15, in which the charge transporting material is contained in the charge transporting layer at an amount of 0.02 to 2 parts by weight on the basis of 1 part by weight of the binder resin.

17. The laminated photosensitive member of claim 10, in which an impedance of the anodized aluminum layer is within the range between 100 and 250 KΩ.

18. The laminated photosensitive member of claim 10, wherein the charge transporting layer has a thickness of 33 μm to 60 μm.

* * * * *